US007437987B1

(12) United States Patent
Ohnstad et al.

(10) Patent No.: US 7,437,987 B1
(45) Date of Patent: Oct. 21, 2008

(54) BLAST SHIELDING

(75) Inventors: Thomas S. Ohnstad, Salem, OR (US); Russell A. Monk, Salem, OR (US); John P. Martin, Salem, OR (US)

(73) Assignee: High Impact Technology LLC, Tigard, OR (US)

( * ) Notice: Subject to any disclaimer, the term of this patent is extended or adjusted under 35 U.S.C. 154(b) by 82 days.

(21) Appl. No.: 11/527,925

(22) Filed: Sep. 26, 2006

Related U.S. Application Data

(60) Provisional application No. 60/721,371, filed on Sep. 27, 2005, provisional application No. 60/724,387, filed on Oct. 6, 2005.

(51) Int. Cl.
*F41H 5/24* (2006.01)

(52) U.S. Cl. ..... 89/36.04; 89/36.02; 244/114 B

(58) Field of Classification Search ..... 404/6; 244/114 B; 405/286, 284; 52/84, 245, 596, 52/608; 89/36.02, 36.04; 181/210
See application file for complete search history.

(56) References Cited

U.S. PATENT DOCUMENTS 5,127,609 A 7/1992 Lynn
5,429,324 A 7/1995 Lynn
6,174,587 B1 1/2001 Figge, Sr.
6,200,063 B1 * 3/2001 Fritzinger ..... 404/6
6,200,664 B1 3/2001 Figge et al.
6,802,477 B2 10/2004 Campion
2004/0146347 A1 7/2004 Davis et al.

* cited by examiner

*Primary Examiner*—J. Woodrow Eldred
*Assistant Examiner*—Gabriel J Klein
(74) *Attorney, Agent, or Firm*—Jon M. Dickinson, PC; Robert D. Varitz, PC

(57) ABSTRACT

A blast shockwave shield including an upright, monolithic body having a lateral center, and front and back sides, and a blast-facing, curved strike face formed on the upright, front side of the body, including a pair of companion, laterally spaced, laterally symmetric, non-coextensive, curved, strike-face portions, each of which defines a blast shockwave-deflection vector that is aimed upwardly, and laterally outwardly away from the shield's lateral center. This structure implements a method for blast shockwave deflection which includes the steps of engaging and intercepting such a shockwave with an upright, monolithic, solid-resistance instrumentality having a pair of laterally spaced, curved, non-coextensive strike-face portions, and, by those acts of engaging and intercepting, reversely deflecting an impinging shockwave.

17 Claims, 3 Drawing Sheets

BLAST SHIELDING

CROSS REFERENCE TO RELATED APPLICATIONS

This application claims priority to each of two, prior-filed, currently pending U.S. Provisional Patent Applications, including Application Ser. No. 60/721,371, filed Sep. 27, 2005 for "Blast Shroud and Method", and Application Ser. No. 60/724,387, filed Oct. 6, 2005 for "Liquid Back-Spray Blast Shroud and Method". The entire disclosure contents of these two provisional applications are hereby incorporated herein by reference.

BACKGROUND OF THE INVENTION

In recent years, and at different locations throughout the United States and in other countries, there have occurred terrorist-like activities involving the clandestine placement, typically in a vehicle, of high-energy explosives, near the outsides of buildings to create powerful and devastating, unprovoked explosions which have completely, or substantially, destroyed a target building with attendant loss of life regarding personnel in such a building. A great deal of preventive attention has been paid to this vicious and dangerous tactic, and the present invention takes, as its focus, the furnishing of practical and effective protection against such acts of terrorism.

SUMMARY OF THE INVENTION

In particular, the present invention offers a unique shielding methodology, and an associated, ground-level shield structure, regarding which the relevant shield structure can be assembled near the outside of a building in the form of plural, repetitive, modular, upright monolithic blast shields which stand in side-by-side near-adjacency. Each of these shields employed in practicing the methodology of the invention, includes a specially shaped, outwardly facing, front blast "strike face" having a pair of laterally spaced strike-face portions that have been proven to provide an extremely effective defense against a blast, or explosion, of the type mentioned above. The shield of the present invention stands as an upright, hollow-bodied or solid-bodied device possessing an outwardly facing, curved, front strike face which is divided into two laterally adjacent, curved, outwardly facing strike-face portions having curvatures which curve rearwardly from top-to-bottom in one embodiment of the invention, and in a modified embodiment also curve rearwardly from side-to-side.

The just first-mentioned kind of curvature is referred to herein as curvature in a height manner, and the second-mentioned kind of curvature as curvature in a width manner. These curved strike-face portions act, with respect to an impinging blast shockwave, to engage and intercept that shockwave in such a fashion that laterally upwardly and downwardly curving deflection waves are created in such a way that damage will be significantly reduced relative to a protected structure, with minimized, associated personnel injury. In particular, the shield of the present invention responds to a striking blast shockwave by reversely deflecting substantially the entirety of the low-ground-level portions of such a shockwave upwardly and laterally outwardly, as well as downwardly and away from the guarding shield, in a manner which tends substantially to isolate a protected building behind the shield, and to guard it against catastrophic blast damage.

In the form of the invention where shields are constructed as hollow-bodied structures, a fungible, flowable fill material, such as sand or water, may be used and contained within the hollow interior of each shield to aid in blast-force mitigation. Where a liquid, such as water, is so employed, the body of each hollow-bodied shield may be equipped with automatically-responding, conventional-construction, blast-openable ports which open to release shield-contained water on the occurrence of a blast, thus further to dissipate blast energy and mitigate blast damage.

As was mentioned above, a shield made in accordance with the present invention may be either hollow-bodied or solid-bodied. The shield body, in relation to either one of these two, specifically different body styles, may be made of different selectable materials, such as steel or concrete. For illustration purposes herein, a preferred embodiment of, and manner of practicing, the invention are described and illustrated in the context of a steel-hollow-bodied, water-filled shield structure—an "approach" which has been found to offer special utility in many applications.

These and other features and advantages which are offered by the present invention will become more fully apparent as the description thereof presented hereinbelow is read in conjunction with the accompanying drawings. In this context, while the concept of providing anti-blast building protection is specifically discussed herein, the term building should be taken to include other kinds of structures which are readily protectable by the present invention.

Regarding all of these drawing figures, one should note that the various invention components illustrated therein are not necessarily drawn to scale.

DETAILED DESCRIPTION OF THE INVENTION

Figure 1:
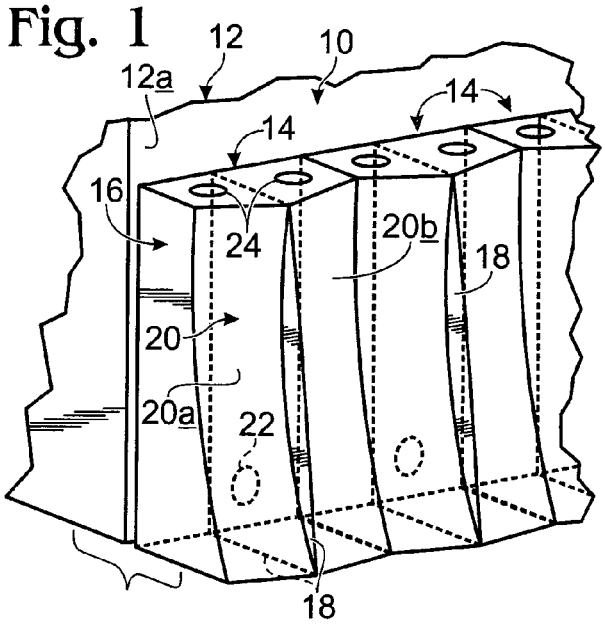
FIG. 1 provides an isometric, fragmentary view of three, side-by-side-disposed blast shields, or solid-resistance instrumentalities, constructed in accordance with one embodiment of the present invention, which instrumentalities include blast-facing strike faces each formed with a pair of unidirectionally curved strike-face portions. The shields shown in FIG. 1 are seen deployed somewhat outwardly of the protected lower wall region of a building which is also shown fragmentarily in this figure. The illustrated shields in FIG. 1 form part of a soldier-course of side-by-side-adjacent shields deployed along the entire side of the fragmentarily illustrated building wall.
Figure 2:
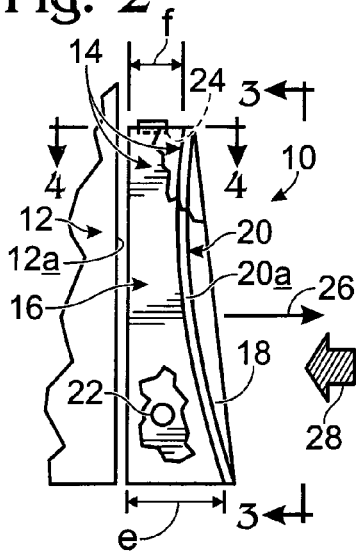
FIG. 2 is a slightly smaller-scale side elevation of a pair of the shields shown in FIG. 1, taken generally from the left aide of FIG. 1. A fragmentation line near the top of FIG. 2 permits partial viewing of two, next-adjacent shields.
Figure 3:
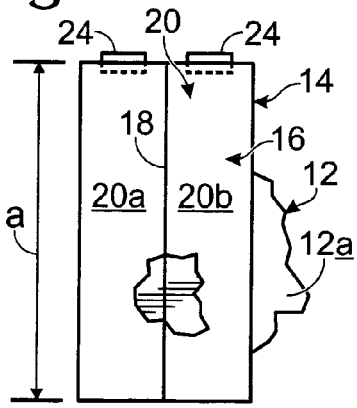
FIG. 3 is a front elevation of one of the shields illustrated in FIGS. 1 and 2, taken generally along the line 3-3 in FIG. 2.
Figure 4:
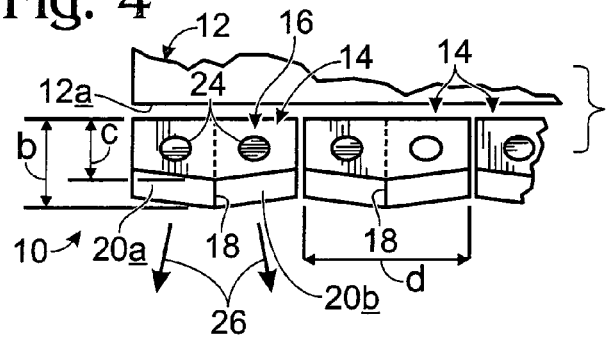
FIG. 4 is a top plan view of the shields shown in FIGS. 1-3, inclusive, taken generally along the line 4-4 in FIG. 2.

Turning now to the drawings, and referring first of all to FIGS. 1-4, inclusive, indicated generally at 10 in FIGS. 1, 2 and 4 is a soldier-course installation 10, spaced somewhat outwardly from the ground-level outside wall 12*a* of a building 12, of plural, side-by-side-adjacent, blast-protection shields 14, each of which has a generally upright, hollow, elongate, monolithic, sheet-steel body, such as body 16. Detailed description of each shield 14, all of them being alike, will now continue with reference just to one of the shields, and namely that one shield whose body 16 is specifically number-labeled in these three figures.

Each of shields 14 herein is designed, in the illustration now being given, to blast-protect a lateral portion of the ground-level region of outside wall 12*a* in building 12, with the entire soldier-course of these shields functioning to protect a long stretch of this wall. Each such shield has an overall height shown at a in FIG. 3 of about 12-feet, a maximum base depth (front-to-back at the bottom, lateral center of the shield) shown at b in FIG. 4 of about 24-inches, a maximum top depth (front-to-back at the top, lateral center the shield) shown at c in FIG. 4 of about 12-inches, and a width d, as seen in FIG. 4, of about 5-feet. At opposite lateral sides of each shield, the shield has a common, minimum bottom depth (e in FIG. 2) of about 20-inches, and a common, minimum top depth (f in FIG. 2) of about 8-inches. The mentioned width of about 5-feet may readily be increased if desired, for example, to employ a relatively smaller number of individual shields aligned side-by-side along a wall in a building. This is purely a matter of designed choice.

Each shield body 16 is hollow in form, and is divided laterally centrally by a generally planar, upright, central baffle 18 which has, as perhaps can best be seen in FIGS. 1 and 2, a somewhat trapezoidal side profile. As can be seen especially well in FIG. 2, portions of baffle 18 project outwardly and forwardly of other components in body 16.

In the particular embodiment of a blast shield now being described, the front side of each shield body is formed with a forwardly facing, rearwardly and top-to-bottom curving strike face 20 which is divided, essentially by forwardly projecting baffle 18, into two, laterally-spaced, next-adjacent, laterally symmetric, non-coextensive strike-face portions shown at 20*a*, 20*b*. As can be seen in FIGS. 1, 2 and 3, each strike-face portion, relative to its companion, next-adjacent, neighboring strike-face portion, faces slightly laterally outwardly away from central baffle 18, which thus functions as a lateral divider between these two strike-face portions.

While different specific materials (as mentioned earlier), and thickness dimensions thereof, may be employed for sheet material which makes up each shield body 16, in the construction now being illustrated, the rear wall (not specifically labeled) in each shield body is formed of sheet steel with a thickness of about 1-inches, with the outer, lateral side walls being formed of sheet steel having a thickness of about ½-inches. The tops and bottoms of each body 16 are formed of sheet steel having a thickness of about ½-inches, and each central baffle 18 is also formed of sheet steel having a thickness of about ½-inches.

Formed in each baffle 18, on the inside of the associated shield body, is an opening, such as that shown in dashed lines at 22 in FIG. 1, and in a solid line in FIG. 2. Each top sheet in each body 16 is provided with a pair of selectively openable and closeable access ports 24.

While each shield may be employed simply as an empty, hollow-bodied unit, preferably this body is filled with a fungible, flowable fill material, such as sand, or a liquid like water. In each body, opening 22 in the central baffle functions to enable laterally balanced water filling of the inside of body 16. If a choice is made to fill a shield body with sand, or the like, use of both ports 24 for filling purposes accommodates lateral fill balancing.

The curvature which exists in a top-to-bottom, rearwardly curving manner in strike-face portions 20*a*, 20*b* may follow any desired curvature line. The particular curvature illustrated in FIGS. 1 and 2 is generally circular curvature.

With the strike-face portions in a shield 14 constructed as just generally described, they are associated with opposite-direction, outwardly directed (away from central baffle) blast-reflection, or blast-deflection, vectors, such as those shown by arrows 26 in FIGS. 2 and 4. These vectors are also aimed slightly upwardly, as can be seen in FIG. 2.

As illustrated in FIGS. 1, 2 and 4 herein, shields 14 are spaced quite closely adjacent building wall 12*a*, and specifically at a distance of about 6-inches.

If and when a blast occurs on the side of building 12 defined by wall 12*a*, outwardly of shields 14, the ground-level portion of this blast advances toward the building as a shockwave, as illustrated very generally by shaded arrow 28 in FIG. 2. When this occurs, the strike-face portions in each blast shield cause, complex, curvilinear reflections, or deflections, of the impinging blast shockwave, which reflections curve upwardly, downwardly, and laterally outwardly in opposite directions away from central baffle 18 in each blast shield, with the "reversely deflected" sum of such reflections/deflections generally following the directions of vectors 26. Where two next-adjacent shields lie, their respective, next-adjacent strike-face portions produce shockwave reflections/deflections which tend to clash and interfere in a manner creating blast-energy-effect-reducing turbulence.

The net effect of this behavior is that even relatively massive blast events have been found to be successfully deflected by a soldier course of blast shields such as those shown in FIGS. 1-4, inclusive, with the result that little appreciable damage occurs to a protected building wall, such as building wall 12*a*.

Figure 5:
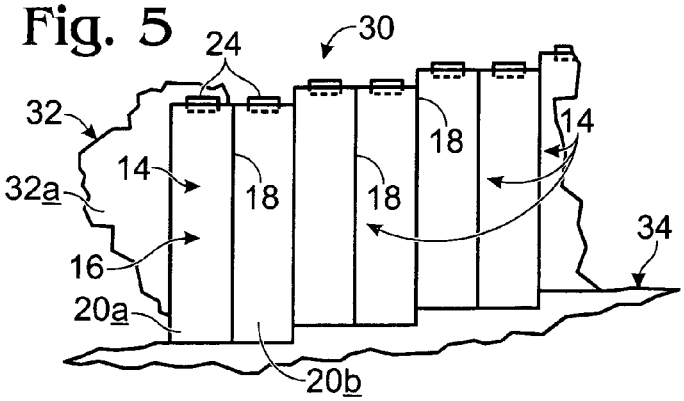
FIG. 5 is a fragmentary side elevation illustrating a soldier-course of shields, like the soldier-course those shields pictured in FIGS. 1-4, inclusive, arranged in a kind of stair-step, lateral distribution along the wall of a building which rises from, and extends along, an upwardly and to the right (in FIG. 5) sloping ground.

Turning attention now to the modified shielding arrangement shown in FIG. 5, here, indicated generally at 30 is a portion of another soldier-course disposition of blast shields 14. This different soldier-course is somewhat stair-stepped, as seen in FIG. 5, so as to accommodate protection in a building 32 of a building wall 32*a* which faces outwardly on an inclined ground level, such as that shown generally at 34 in FIG. 5.

Figure 6:
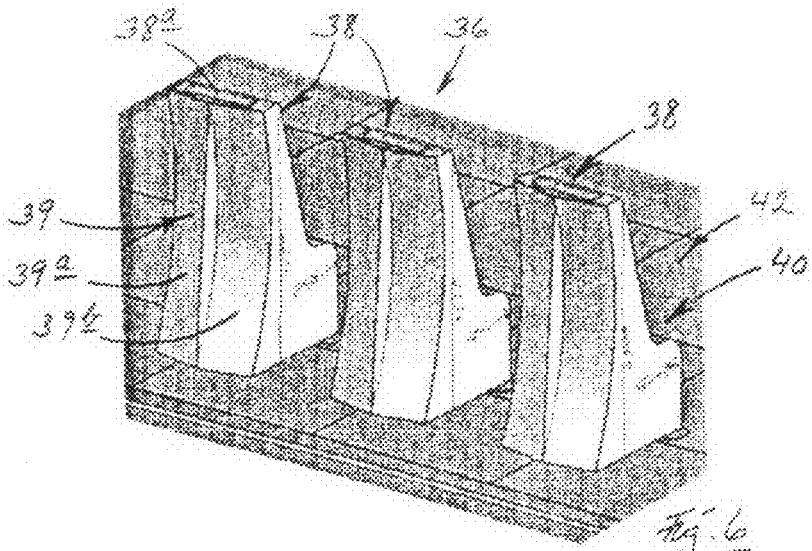
FIG. 6 is a fragmentary, protection-side view of three modified blast shields made in accordance with one modified form of the present invention, illustrated in another kind of soldier-course distinguished from the soldier-course pictured in FIGS. 1-5, inclusive.

With reference now to FIG. 6 in the drawings, here what is shown generally at 36 is yet another, and quite different, kind of soldier-course of blast shields, formed with shields which are constructed with modified configurations as compared to the configurations of previously described shields 14. In FIG. 6, three such differently configured blast shields 38 are shown, with their front, blast-facing sides disposed generally toward the viewer in FIG. 6, and their back, building-facing sides facing away from the viewer in this figure, "aimed" toward a somewhat more distantly spaced (typically about 20-feet) building wall, not specifically shown in this figure.

Each of shields 38 is configured to have a central-baffle-divided strike face 39 divided into two strike-face portions 39*a*, 39*b* which are like previously mentioned strike face portions 20*a*, 20*b*, respectively. Shields 38 are constructed to offer a kind of dual functionality, in the sense that their back sides, i.e., their building-facing sides, are shaped somewhat to function conveniently as seating benches, such as bench 40. Other options include "building-side" shaping to create other kinds of amenity features, such as planters, picnic tables, etc. While FIG. 6 does not show a "frontal" view of benches 40, a further, somewhat modified form of blast shield pictured in FIGS. 7, 8 and 9 does illustrate, particularly in FIG. 8 (see reference number 46), such a bench. Shields 38 thus furnish a secondary utility as seating structures in addition to providing blast shielding for a building.

Except for the fact that the back sides, i.e., the building-facing sides, of shields 38, and the relevant side-appearance configurations of these shields, are specifically different from those of previously described shields 14, in many respects, the constructions of shields 38 are much like the constructions of shields 14. Each shield 38 is formed preferably of appropriately thick sheet steel material to have a hollow body accessible through an upper access port, such as the port shown at 38*a*, for the introduction of suitable, fungible fill material, such as sand or water, and with the height and width dimensions of shields 38 being similar to the height and width dimensions stated earlier herein typically for shields 14.

The soldier-course placement concept illustrated in FIG. 6 for shields 38 differs principally from that shown in FIGS. 1-4, inclusive, in that the next-adjacent shields are spaced apart by a distance of about 2-feet, or so, in order to provide a "people through-passage" between such next-adjacent shields, and with all of these shields being spaced outwardly from the protected wall in a building by a distance, mentioned above, of about 20-feet, which distance affords a pedestrian walkway 42 along the back, bench-containing, building-facing sides of shields 38. For certain building-protection applications, the arrangement thus illustrated in FIG. 6, with the bench-seating structural modifications generally illustrated in this figure, and with next-adjacent shields being spaced apart by a distance such as that just stated, have been found to provide appropriate anti-blast protection.

Figure 7:
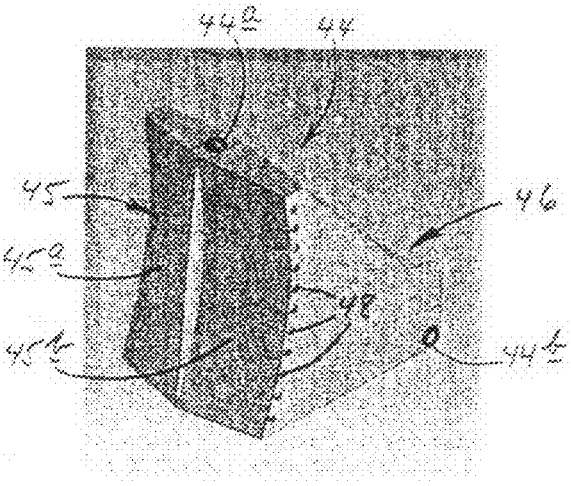
FIGS. 7, 8 and 9 present three different views of yet another modified form of blast shield made in accordance with the invention.
Figure 8:
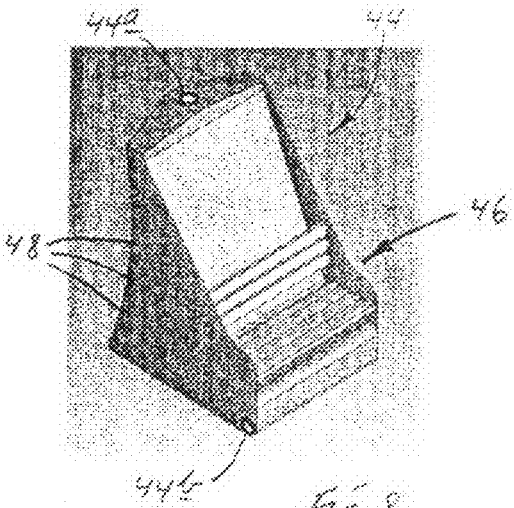
Figure 9:
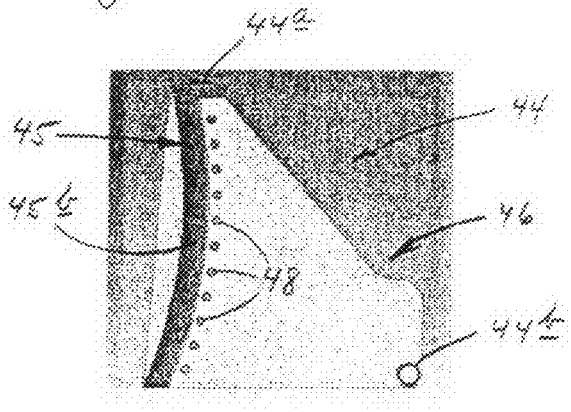

Addressing attention now to FIGS. 7, 8 and 9, here, shown in isolation generally at 44 is another slightly modified style of blast shield constructed in accordance with the present invention. Shield 44 is quite similar in configuration to just previously described shield 38, except that its specific dimensions, and its relevant aspect ratios regarding height, width and depth, are slightly different. As was mentioned earlier, FIG. 8 illustrates at 46 a rear-side, building-facing-aide seating bench configuration which typifies the rear-side construction of each shield 44.

Each shield 44 is formed of appropriate-thickness sheet steel material to have a hollow body which is accessible through an upper access port, such as port 44*a*, and in this case, is intended particularly for filling with a liquid such as water. A water drain port 44*b* is provided adjacent the rear base of the hollow body in each shield 44.

The blast-facing side of each shield 44 is furnished with a curved strike face 45 which is divided by the same kind of central upright baffle previously described herein into two, laterally spaced, curved strike-face portions 45*a*, 45*b* which correspond to previously described strike-face portions 20*a*, 20*b* in shields 14.

Included on the laterally opposite sides of each shield 44 are plural, vertically arrayed, blast-openable water outlet ports such as those shown at 48. Such ports may conveniently be provided on the laterally opposite sides of the hollow body in each shield 44. These ports, on the occurrence of impact by a blast shockwave, open substantially immediately to vent water in the forms of sprays directed laterally outwardly from the blast shields. These sprays, in addition to relieving water pressure inside each shield to mitigate blast-force-anticipated energy, also have been noted to function on the outsides of the blast shields to mitigate and diminish damaging blast energy. Valve-like devices which can so function in ports 48 may be entirely conventional in construction, and thus are not detailed herein.

Plural blast shields made in accordance with FIGS. 7, 8 and 9 are typically employed in an appropriate soldier-course generally in a manner illustrated for shields 38 in FIG. 6.

Figure 10:
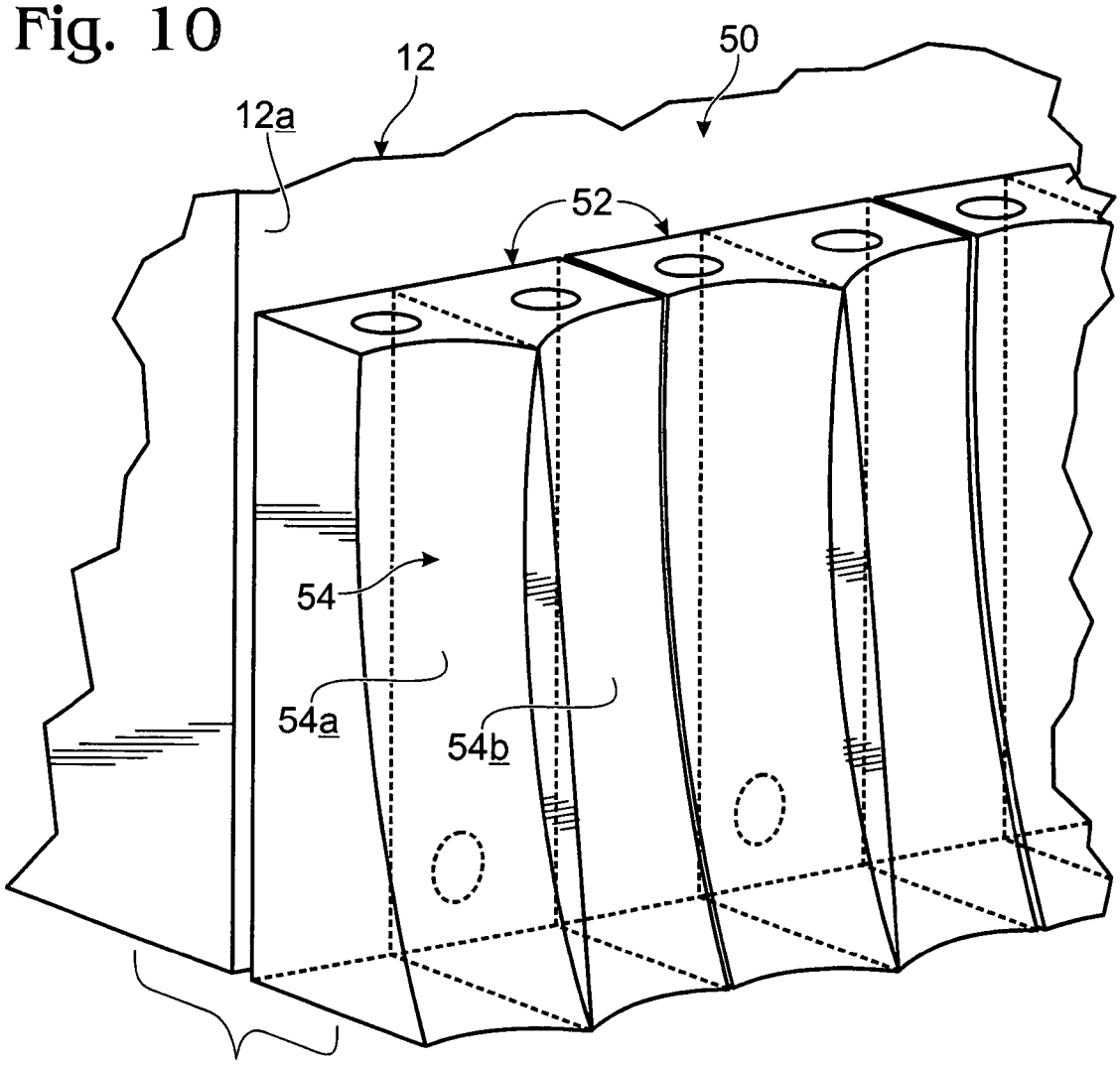
FIG. 10 is similar to FIG. 1, except that it shows a still further modified form of blast shield which features compound-curvature strike-face portions.

Turning attention finally to FIG. 10 in the drawings, this figure illustrates at 50 a fragmentary soldier-course of blast shields 52 which are much like earlier-described blast shields 14 pictured in FIGS. 1-5, inclusive. Shields 52 differ from shields 14 principally in that their included strike faces 54 possess laterally spaced strike-face portions 54*a*, 54*b*, which generally correspond, respectively, to strike-face portions 20*a*, 20*b* in shields 14, but are defined with compound curvatures which curve not only in a top-to-bottom manner, as is true for strike-face portions 20*a*, 20*b*, but also in a side-to-side, or width, manner, as can clearly be seen by the lateral curvatures pictured for these strike-face portions in FIG. 10. In substantially all other respects, blast shields 52 are like blast shields 14.

There have thus been disclosed and described herein several embodiments of unique, upright, monolithic blast shields which engage and intercept an oncoming blast shockwave aimed, for example, at the side of a building. They do this employing curved strike faces divided laterally into two, curved strike-face portions that define slightly laterally outwardly and upwardly directed shock-deflection vectors.

The shields of the invention are either hollow-bodied or solid-bodied, and if hollow-bodied, are preferably filled with a fungible, flowable fill material, such as sand or water. In the case of a water-filled, hollow-bodied shield, the shield may be equipped with blast-openable ports which open immediately on the occurrence of an impinging blast shockwave to utilize water-spray escape as a blast-mitigation mechanism.

Those skilled in the art will recognize that specific curvatures, dimensions, materials, and angularities associated with strike face portions may be modified to suit particular applications. Soldier-courses of monolithic blast shields made in accordance with the invention may also be arranged differently to suit different applications. As illustrated in FIGS. 6-9, inclusive, sides of the monolithic shields of the present invention which face protected building structures may be designed with aesthetic and convenience configurations, such as seating configurations to face a protected walkway lying between a solder-course of blast shields and a protected building.

From a methodological point of view, the present invention can be viewed broadly as a method of shielding against a laterally traveling blast shockwave, including the steps of (a) engaging and intercepting such a shockwave with an upright, monolithic, solid-resistance instrumentality which has a pair of laterally spaced, curved, non-coextensive strike-face portions, and (b), by such engaging and intercepting activity, reversely deflecting that shockwave.

Accordingly, while several important and very useful embodiments of the invention have been specifically illustrated and described herein, and a related, representative methodology expressed, it is appreciated that variations and modifications therein may be made without departing from the spirit of the invention.

We claim:

1. A blast shockwave shield comprising an upright, monolithic, non-elastic body having a lateral center, and front and back sides, and a blast facing, curved strike face formed on the upright, front side of said body, including a pair of companion, laterally spaced, laterally symmetric, non-coextensive, curved, strike-face portions, each of which defines a blast shockwave-deflection vector that is aimed upwardly, and laterally outwardly away from the shield's lateral center.

2. The shield of claim 1, wherein each strike-face portion is curved rearwardly in a height manner.

3. The shield of claim 1, wherein each strike-face portion is curved rearwardly in both height and width manners.

4. The shield of claim 1, which has a lateral side profile with a top and a bottom, and wherein said profile bottom has an overall, front-to-back lateral dimension which is greater than that of said top.

5. The shield of claim 1, which further includes a forwardly and outwardly projecting, upright, central baffle which forms a divider between said strike-face portions.

6. The shield of claim 1, which forms part of a soldier-course of plural, like, laterally-next-adjacent shields.

7. The shield of claim 1, wherein said body is a hollow structure adapted to receive a fungible, flowable fill material drawn from a list including (a) a solid particulate material, and (b) water.

8. The shield of claim 1, wherein said body is a hollow structure adapted to receive water, and included in said body are plural, blast-openable, water-outflow ports.

9. A method of shielding against a laterally traveling shockwave of a blast comprising engaging and intercepting such a shockwave with an upright, monolithic, non-elastic, solid-resistance instrumentality having a pair of laterally spaced, curved, non-coextensive strike-face portions, and by said engaging and intercepting, reversely deflecting that shockwave.

10. A blast shockwave shield comprising an upright, monolithic, non-elastic body having a lateral center, and front and back sides, and a blast-facing curved strike face formed on the upright, front side of said body, including a pair of companion, laterally spaced, laterally symmetric, non-coextensive, smoothly curved, strike-face portions, each of which defines a blast shockwave-deflection vector that is aimed upwardly, and laterally outwardly away from the shield's lateral center.

11. The shield of claim 10, wherein each strike-face portion is curved rearwardly in a height manner.

12. The shield of claim 10, wherein each strike-face portion is curved rearwardly in both height and width manners.

13. The shield of claim 10, which has a lateral side profile with a top and a bottom, and wherein said profile bottom has an overall, front-to-back lateral dimension which is greater than that of said top.

14. The shield of claim 10, which further includes a forwardly and outwardly projecting, upright, central baffle which forms a divider between said strike-face portions.

15. The shield of claim 10, which forms part of a soldier-course of plural, like, laterally-next-adjacent shields.

16. The shield of claim 10, wherein said body is a hollow structure adapted to receive a fungible, flowable fill material drawn from a list including (a) a solid particulate material, and (b) water.

17. The shield of claim 10, wherein said body is a hollow structure adapted to receive water, and included in said body are plural, blast-openable, water-outflow ports.

* * * * *